US005632524A

United States Patent [19]

Ikeda et al.

[11] Patent Number: 5,632,524

[45] Date of Patent: May 27, 1997

[54] COMBINATION CHAIR

[75] Inventors: Shigeru Ikeda, Kunitachi; Hisao Matsumoto, Mizuhomachi; Natsuko Hiramatsu, Yokohama; Hideki Iwashita, Koganei; Hisaya Umemoto, Akishima; Shin Takagi, Sakura, all of Japan

[73] Assignee: France Bed Co., Ltd., Tokyo, Japan

[21] Appl. No.: 454,243

[22] PCT Filed: Jun. 12, 1995

[86] PCT No.: PCT/JP94/01467

§ 371 Date: Jun. 12, 1995

§ 102(e) Date: Jun. 12, 1995

[87] PCT Pub. No.: WO95/10209

PCT Pub. Date: Apr. 20, 1995

[30] Foreign Application Priority Data

| | | | |
|---|---|---|---|
| Oct. 13, 1993 | [JP] | Japan | 5-255890 |
| Nov. 16, 1993 | [JP] | Japan | 5-286803 |
| Dec. 15, 1993 | [JP] | Japan | 5-066885 |

[51] Int. Cl.[6] ..... A47C 3/04

[52] U.S. Cl. ..... 297/233; 297/239

[58] Field of Search ..... 297/233, 236, 297/239

[56] References Cited

U.S. PATENT DOCUMENTS

| | | | |
|---|---|---|---|
| 1,408,114 | 2/1922 | Mathieu | 297/239 |
| 1,886,172 | 11/1932 | Doetsch . | |
| 5,096,258 | 3/1992 | Mestre Boix | 297/233 |
| 5,308,146 | 5/1994 | Chou | 297/233 X |

FOREIGN PATENT DOCUMENTS

| | | | |
|---|---|---|---|
| 698715 | 11/1930 | France | 297/239 |
| 9112215 | 1/1992 | Germany . | |
| 60-142654 | 9/1985 | Japan . | |
| 60-1553451 | 10/1985 | Japan . | |

*Primary Examiner*—Peter R. Brown

*Attorney, Agent, or Firm*—Frishauf, Holtz, Goodman, Langer & Chick

[57] ABSTRACT

A combination chair including a plurality of chairs which can be separately used or can be combined together as one to be used. Each of the plurality of chairs comprises a seat portion supported by legs and a backrest provided on the seat portion. These chairs are designed so that the backrests thereof are jointed to be adjacent to each other at one side in the width direction when the seat portions of the chairs are stacked up in the up-and-down direction, and the lengths of the legs are set so that the lower ends thereof coincide when the chairs are combined together.

3 Claims, 15 Drawing Sheets

COMBINATION CHAIR

DESCRIPTION

1. Technical Field

The present invention relates to a combination chair which can be used as one chair by combining a plurality of chairs.

2. Background Art

In a dining room, for example, a table and a plurality of chairs are provided. Usually, the chairs are prepared so as to correspond to the number of members in the family. Therefore, in the case where there is a guest or the like, and the number of people using the dining room increases, the number of chairs must be increased in accordance with the number of guests added.

It is possible that extra chairs are always prepared for guests in advance; however extra chairs occupy some space in the room. Therefore, when they are not used, they take up much space. In a house of a narrow living space, it is, in many cases, difficult to reserve a space for placing extra chairs.

SUMMARY OF THE INVENTION

An object of the present invention is to provide a combination chair, in which a plurality of chairs are stacked up into one chair, or vice versa, and therefore the number of chairs can be increased or decreased in accordance with an increase or decrease in number of people using chairs, thus avoiding the occupation of an extra space.

Another object of the present invention is to provide a combination chair in which chairs, when they are stacked up, can be combined into one chair without looseness.

According to an embodiment of the present invention, there is provided a combination chair comprising a plurality of chairs, characterized in that: said plurality of chairs each having a seat portion supported by legs and a backrest provided on the seat portion, and the backrests of the chairs are jointed to be adjacent to each other by one side in the width direction, and lengths of the legs are set so that lower ends thereof coincide with each other.

According to another embodiment of the present invention, there is provided a combination chair comprising a plurality of chairs, characterized in that each of the chairs has a seat portion supported by legs and a backrest provided on the seat portion, the seat portion of each chair is supported by said legs at such a height that the seat portions are stacked one upon another in an up-and-down direction, and inner surfaces of the legs of a chair situated on an upper side are fitted to outer surfaces of the legs of a chair situated on a lower side when the chairs are combined so that the seat portions are stacked up.

According to still another embodiment of the present invention, there is provided a combination chair comprising of a plurality of chairs, characterized in that each of the chairs has a seat portion supported by legs and a backrest provided on the seat portion, the backrest of a chair whose seat portion is located on an upper side, and the backrest of a chair whose seat portion is located on a lower side is fitted in a frame of the backrest of the chair whose seat portion is located on the upper side when said plurality of chairs are combined so that the seat portions thereof are stacked up in the up-and-down direction.

With the above-described structures, a plurality of chairs can be used separately as a single chair, and they can be combined together to be used as one chair. Therefore, the present invention can follow an increase/decrease in the number of users.

When the plurality of chairs are combined together, the slipping movement in the up-and-down direction and horizontal direction can be suppressed, and therefore the combination chair can be easily used as one chair.

BRIEF DESCRIPTION OF THE DRAWINGS

FIG. 2A being a plan view thereof and

FIG. 2B being a front view thereof;

FIG. 3A being a plan view thereof and

FIG. 3B being a front view thereof;

FIG. 4A, being a plan view thereof and

FIG. 4B being a front view thereof;

FIG. 5A being a plan view of a lower surface side of the seat,

FIG. 5B being a side view of the seat taken along the line 5B—5B in FIG. 5A, and FIG. 5C being a cross section taken along the line 5C—5C in FIG. 5A;

FIG. 8A being a plan view showing three chairs are combined and

FIG. 8B being a front view of such a combination;

Figure 15A:
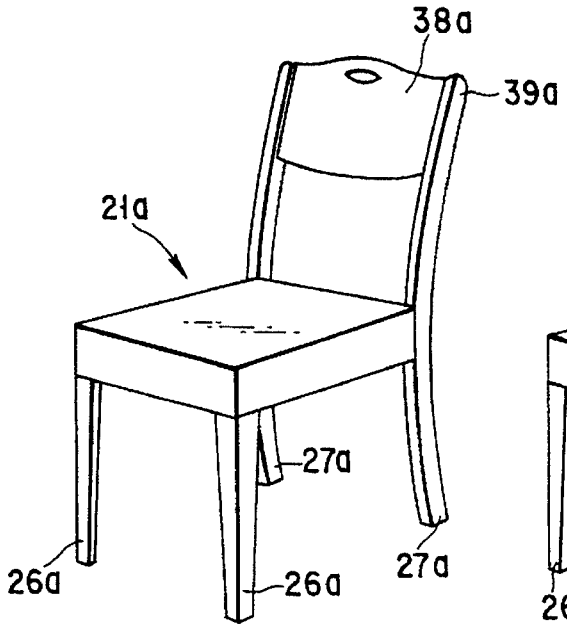
Figure 15B:
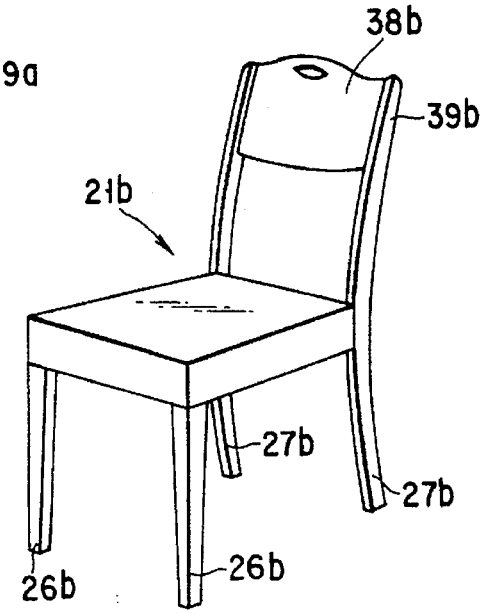
Figure 15C:
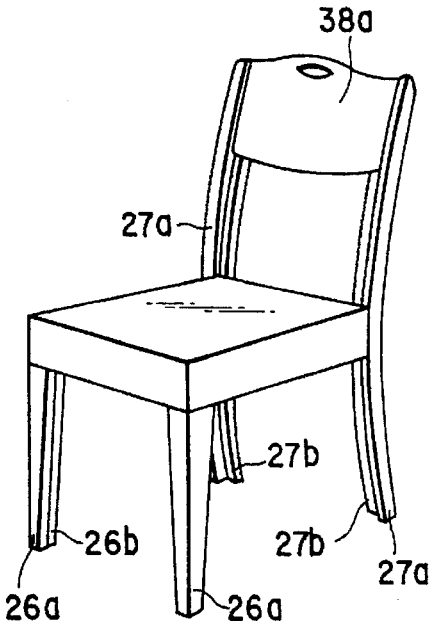
Figure 16:
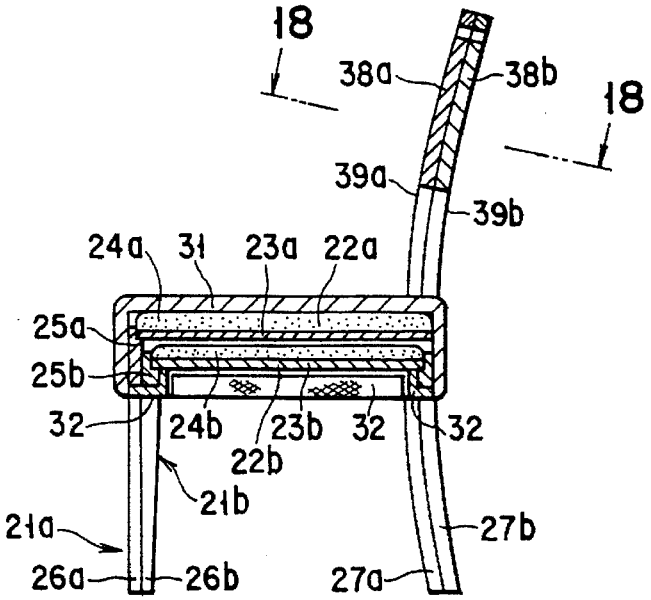
Figure 17:
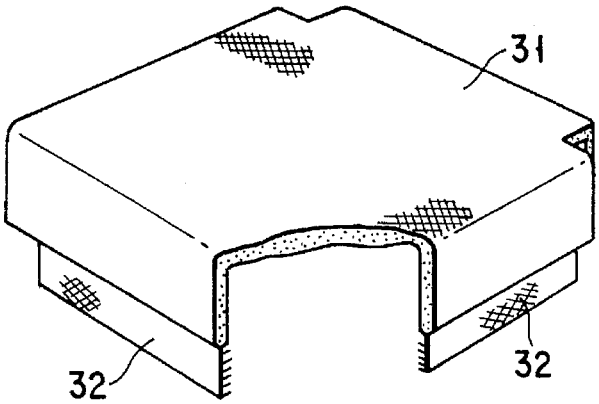
Figure 18:
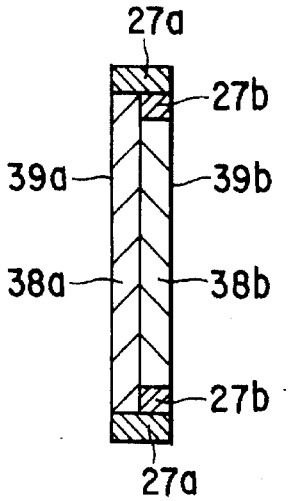
Figure 19:
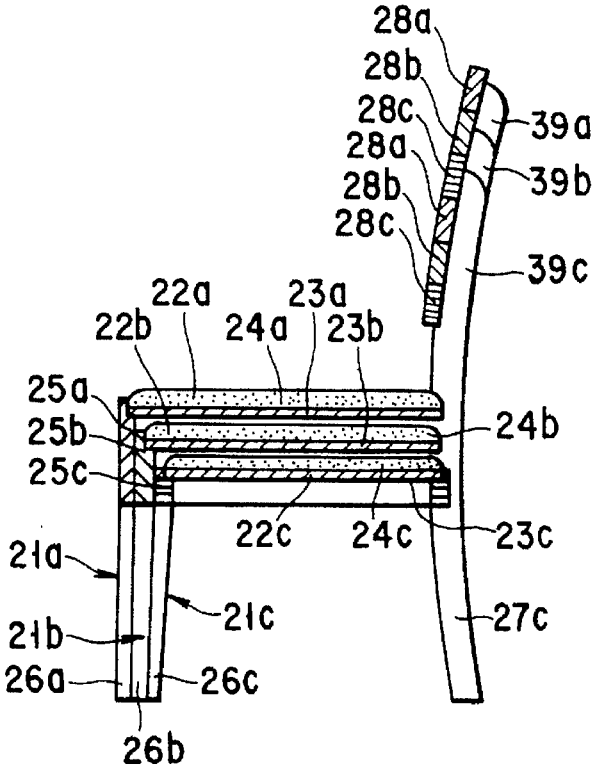
Figure 20A:
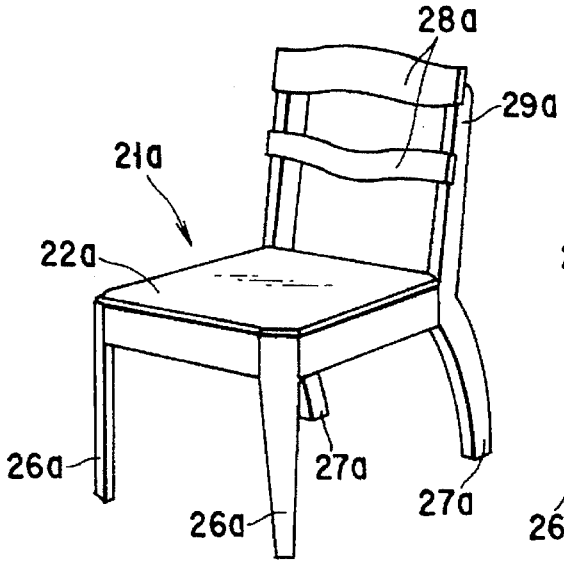
Figure 20B:
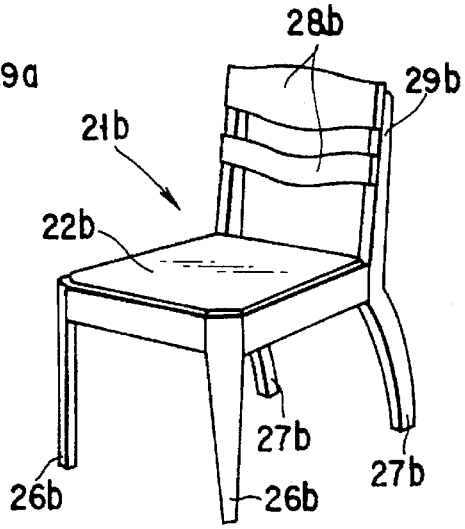
Figure 20C:
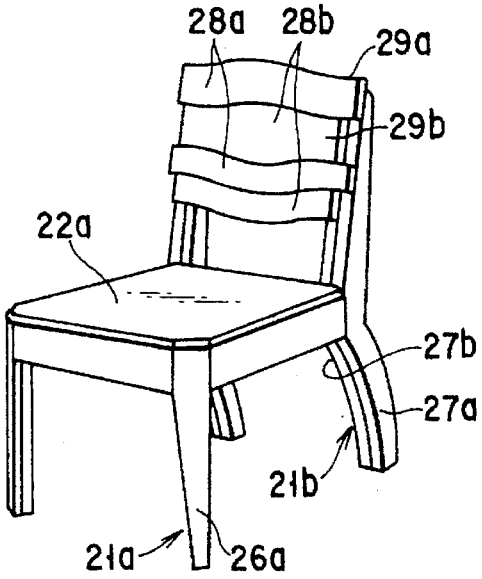
Figure 20D:
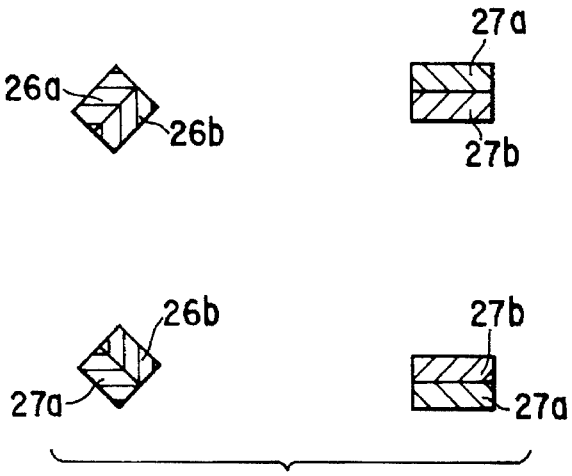
Figure 22A:
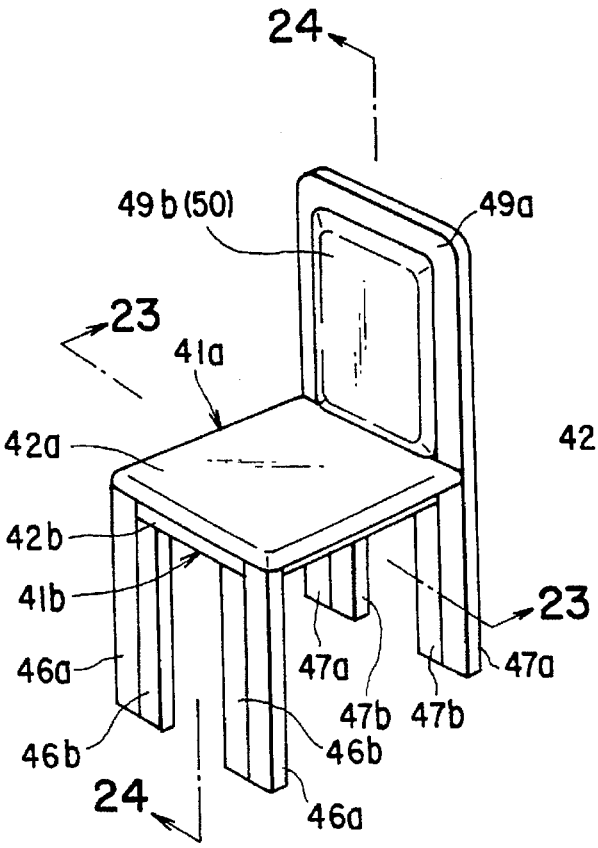
Figure 22B:
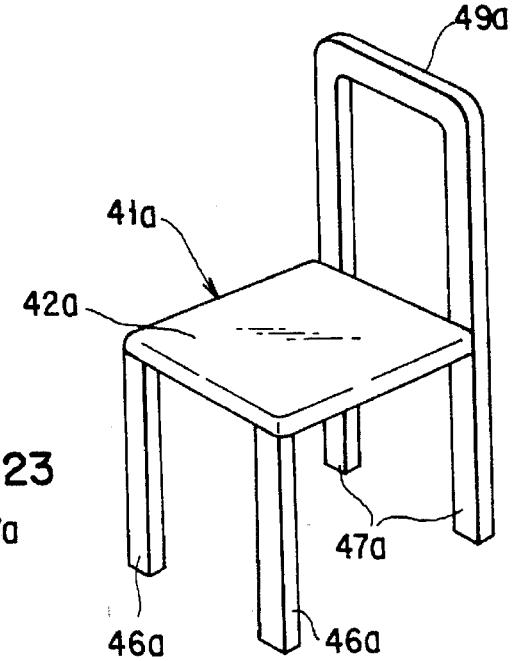
Figure 22C:
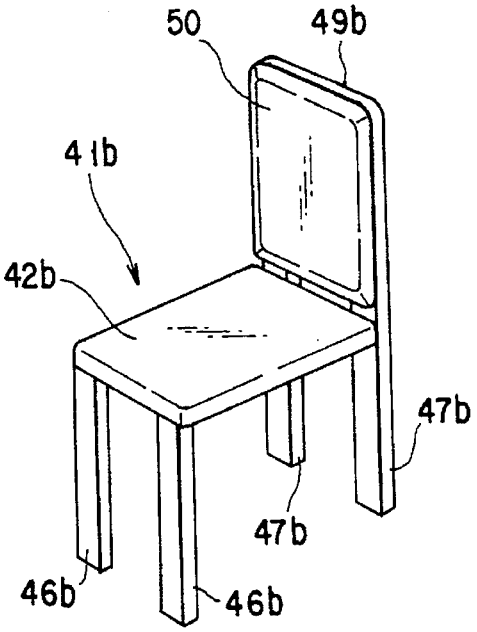
Figure 23:
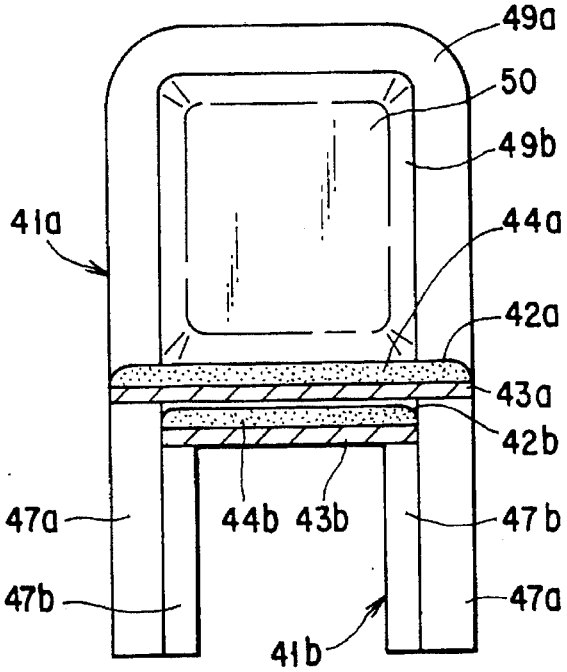
Figure 24:
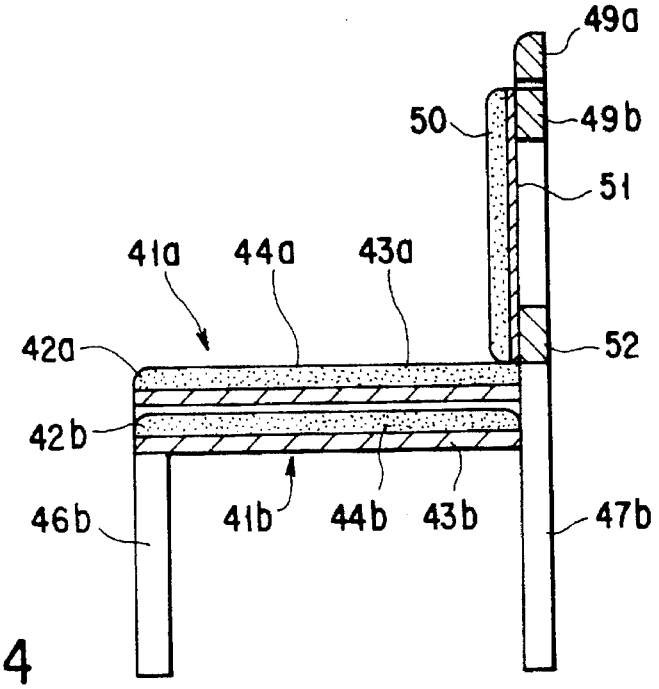
Figure 25:
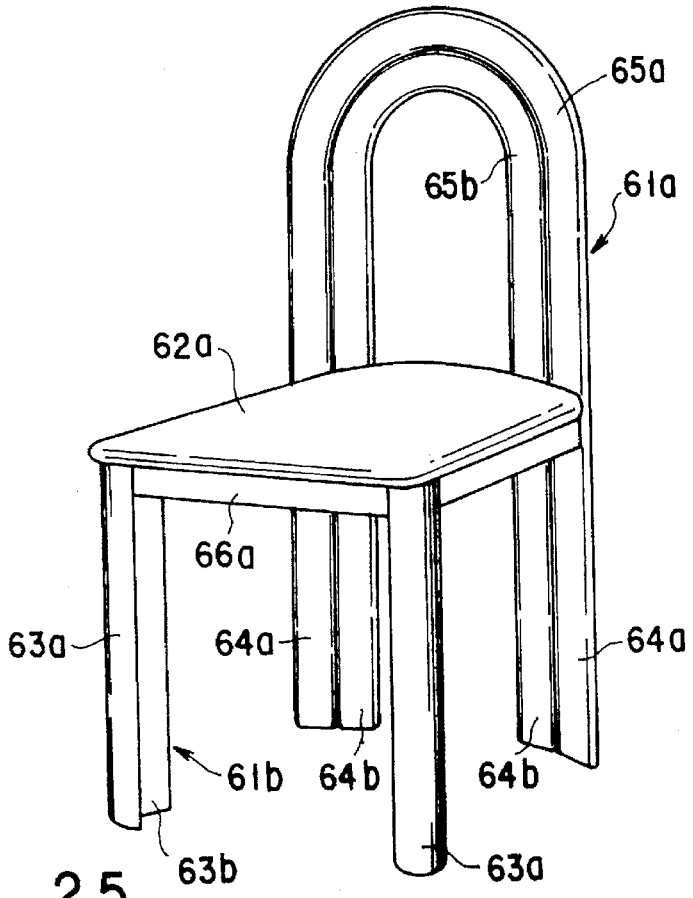
Figure 26A:
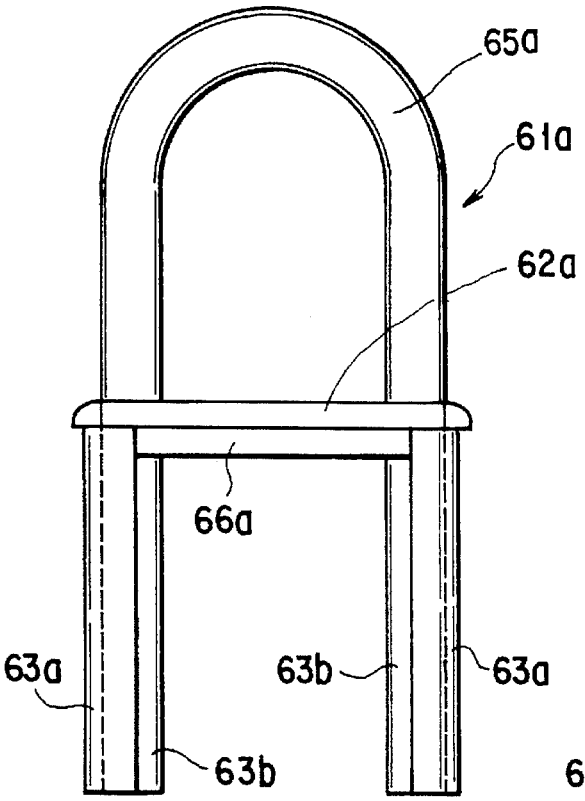
Figure 27A:
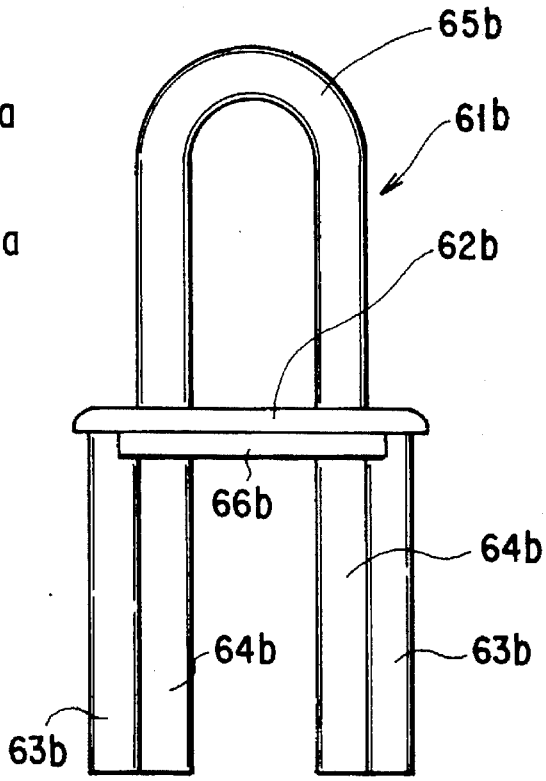
Figure 26B:
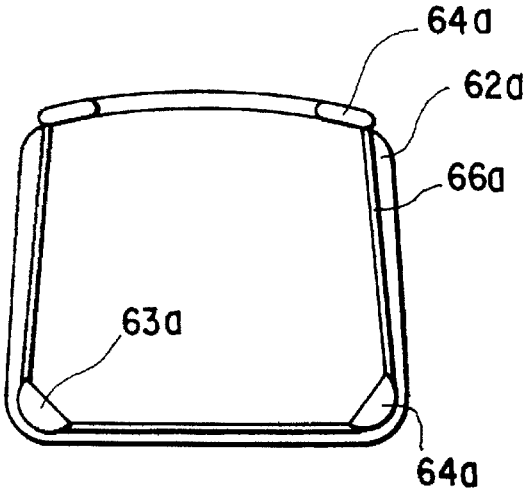
Figure 27B:
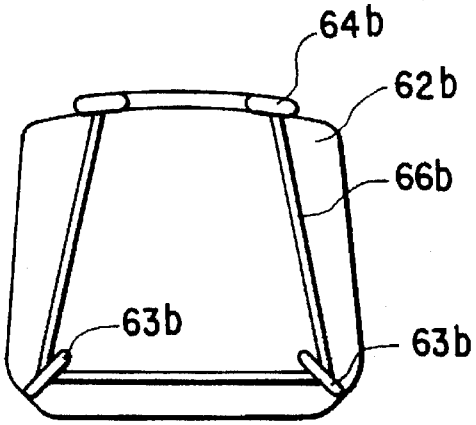
Figure 28A:
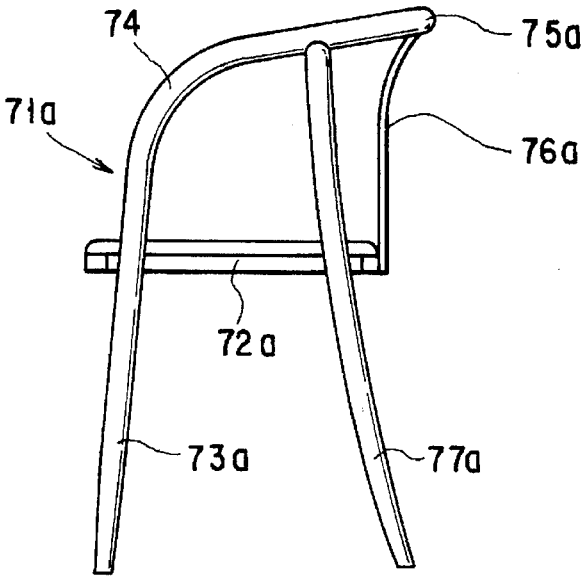
Figure 28B:
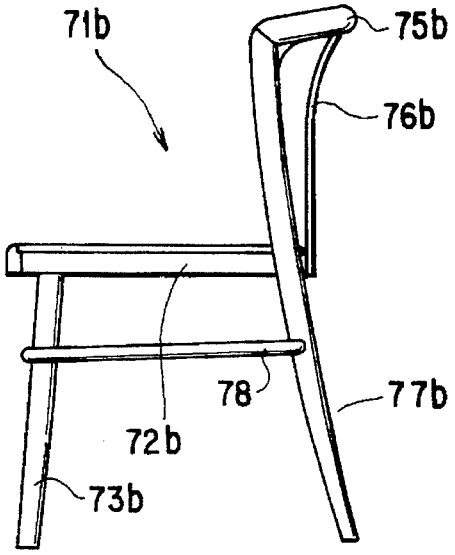
Figure 29A:
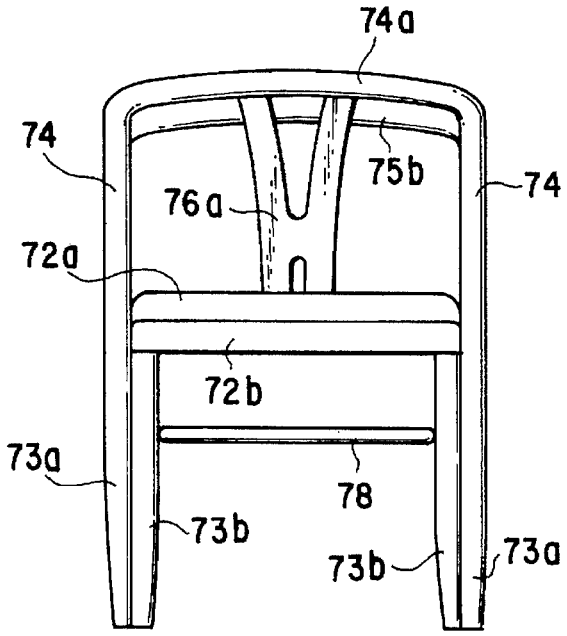
Figure 29B:
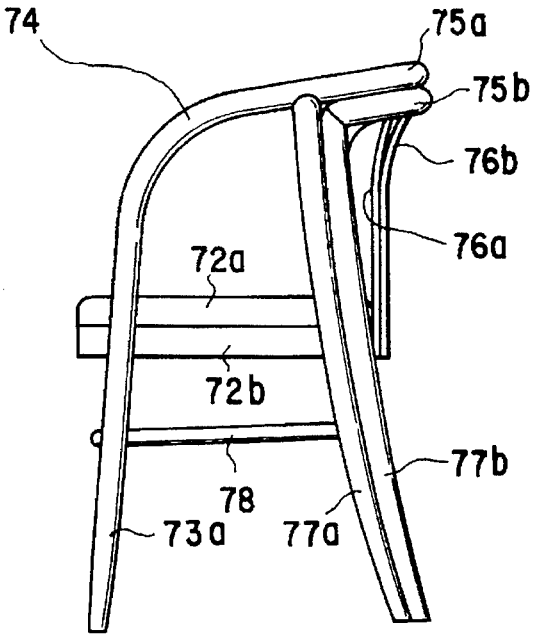

FIGS. and 15A, 15B, 15C are perspective views of a combination chair according to the third embodiment of the present invention, FIG. 15A being a perspective view showing a first chair, FIG. 15B being a perspective view showing a second chair, and FIG. 15C being a perspective view showing the first and second chairs when they have been combined together;

FIG. 16 is a vertical section of the first and second chairs combined;

FIG. 17 is a perspective view of a cover of the combination, partially showing a cross section thereof;

FIG. 18 is a cross section of the combination taken along the line 18—18 in FIG. 16;

FIG. 19 cross section of a remodeled version of the third embodiment, in which three chairs are stacked up;

FIGS. 20A, 20B, 20C and 20D are perspective views of a combination chair according to the fourth embodiment of the present invention, FIG. 20A being a perspective view showing a first chair, FIG. 20B being a perspective view showing a second chair, FIG. 20C being a perspective view showing the first and second chairs when they have been combined together, and FIG. 20D being a cross section of legs of the combined chair;

FIGS. 21A to 21K are cross sections of front legs of different versions;

FIGS. 22, 22B, and 22C are perspective views of a combination chair according to the fifth embodiment of the present invention, FIG. 22A being a perspective view showing first and second chairs which have been combined, FIG. 22B being a perspective view showing the first chair, and FIG. 22C being a perspective view showing the second chair;

FIG. 23 is a front sectional view, along the line 23—23 in FIG. 22A, showing a seat portion of the first and second chairs combined;

FIG. 24 is a lateral cross section, along the line 24—24 in FIG. 22A, of a seat portion and a backrest of the combination of the first and second chairs;

FIG. 25 is a perspective view showing a combination of first and second chairs, according to the sixth embodiment of the present invention;

FIG. 26A is a front view of the first chair of the combination;

FIG. 26B is a bottom view of the first chair of the combination;

FIG. 27A is a front view of the second chair of the combination;

FIG. 27B is a bottom view of the second chair of the combination;

FIG. 28A is a side view of a first chair of a combination chair according to the seventh embodiment of the present invention;

FIG. 28B is a side view of a second chair thereof;

FIG. 29A is a front view showing the first and second chairs which have been combined; and FIG. 29B is a front view showing the first and second chairs combined.

DETAILED DESCRIPTION

Embodiments of the present invention will now be described with reference to drawings.

FIGS. 1 to 7 show the first embodiment of the present invention. A combination chair according to the first embodiment comprises two chairs, as shown in FIGS. 1A to 1C, 2A, 2B, 3A and 3B, more specifically, a first chair 1*a* and a second chair 1*b* having different shapes (in terms of measurements) though they appear to be substantially identical.

The first and second chairs 1*a* and 1*b* include disk-shaped seat portions 2*a* and 2*b* of the same size, respectively. Each of the seat portions 2*a* and 2*b* *is* supported by four legs 3*a* and 3*b* at a predetermined height.

Figure 5C:
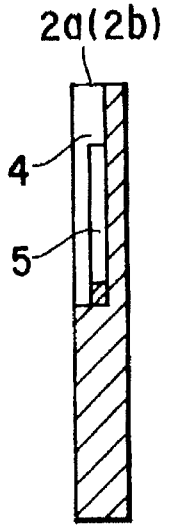
FIGS. 5A, 5B and 5C show a seat portion of the chairs.
Figure 5B:
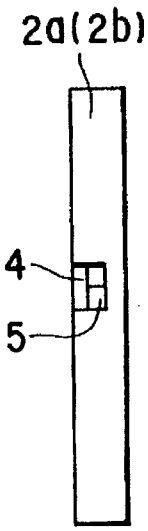
Figure 5A:
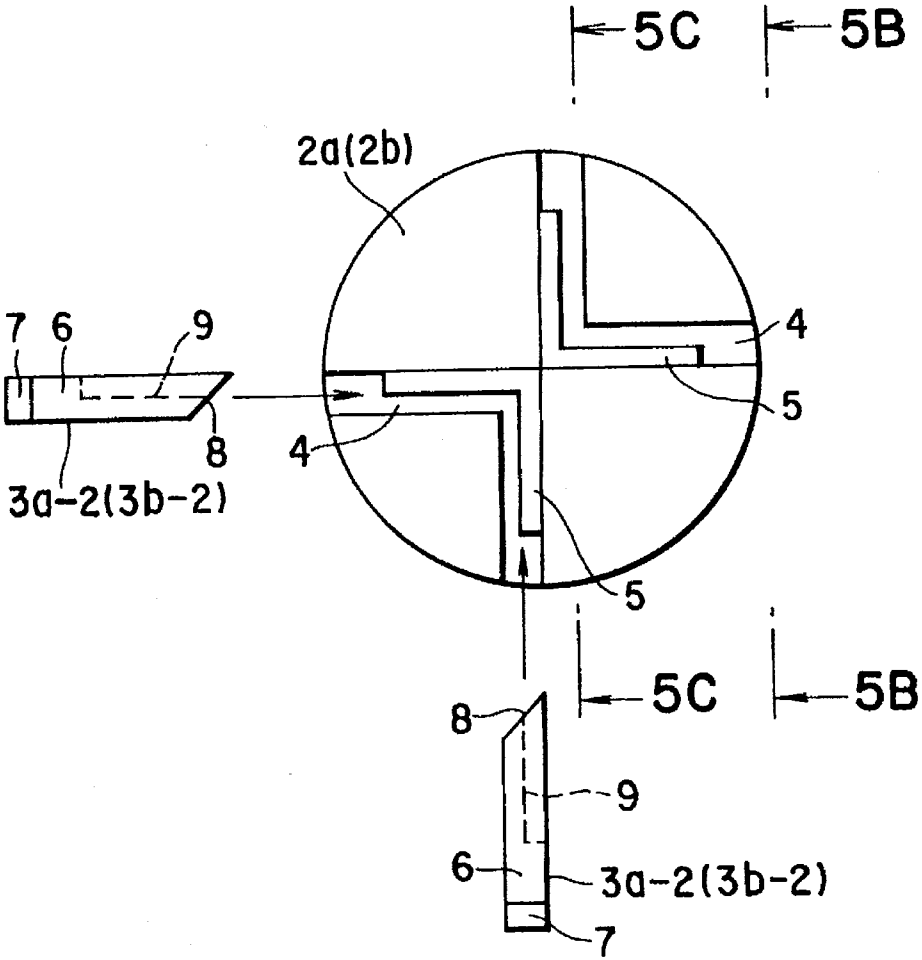

Each of the seat portions 2*a* and 2*b* is jointed to the legs 3*a* and 3*b* as shown in FIGS. 5A to 5C. More specifically, two L-shaped grooves 4 bare formed on the lower surface of each of the seat portions 2*a* and 2*b* as shown in FIG. 5A. The L-shaped grooves 4 abut each other at their outer edges of angle portions at the center of each of the seat portions 2*a* and 2*b*, and the ends of the L-shaped grooves are opened to the outer surfaces of the seat portions 2*a* and 2*b* in the circumferential direction at an interval of 90 degrees. Within the angle portion of each L-shaped groove 4, a step portion 5 having a width of about a half of that of the groove 4 and a height of about a half of the depth of the groove 4, is formed to project.

Figure 6:
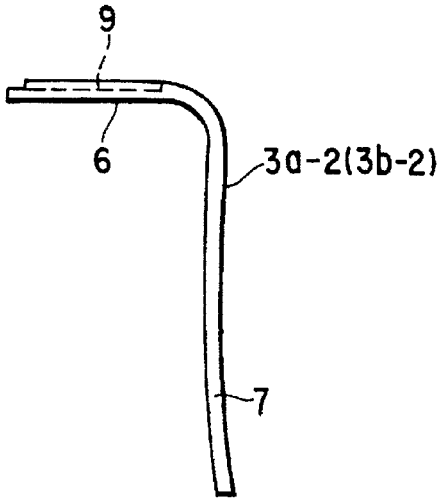
FIG. 6 is a side view of a front leg.

Of the legs 3*a* and 3*b*, each of two front legs 3*a*-2, 3*b*-2 has a joint portion 6 which is made substantially horizontal by bending a wood or metal material into an L-shape, and a support portion 7 which is substantially vertical as shown in FIG. 6. The end of the joint portion 6 is cut at an angle of 45 degrees to be a fit portion 8 as shown in FIG. 5A, and the upper surface thereof has a recess portion 9 which engages with the step portion 5.

Among the legs 3*a* and 3*b*, the joint portions 6 of a pair of the front legs 3*a*-2 and 3*b*-2 are inserted respectively into one and the other ends of each one of the L-shaped grooves 4, so that each recess portion 9 engages with the corresponding one of step portions 5. Thus, the fit portions 8 of the ends of a pair of the joint portions 6 are placed to match with each other, and while maintaining the matching state, the pair of the front legs 3*a*-2 and 3*b*-2 are fixed to that one of the L-shaped grooves 4 by screws or adhesive (not shown). With this structure, the support portions 7 of the pair of front legs 3*a*-2 and 3*b*-2 project downward from the outer circumferential surface of each of the seat portions 2*a* and 2*b*.

Figure 7:
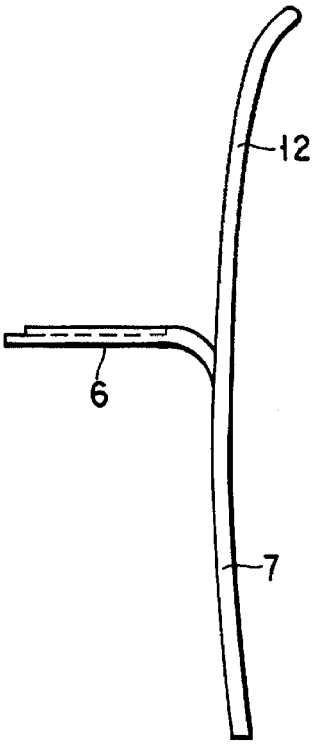
FIG. 7 is a side view of a rear leg.

A pair of rear legs 3*a*-1 and 3*b*-1 have a structure as shown in FIG. 7, in which a joint portion 6, a support portion 7 and a mount portion 12 comprising backrests 11*a* and 11*b*, are integrated into one body. More specifically, the support member 7 and the mount portion 12 are made from one piece material, and the joint portion 6 is integrated by its one end portion to the material at the mid portion thereof, so as to project substantially horizontally therefrom.

The joint portions 6 of each pair of rear legs 3*a*-1 and 3*b*-1 are inserted into the other one of the L-shaped grooves 4 of each of the seat portions 2*a* and 2*b*. Thus, the pair of the rear legs are fixed to the groove in the same manner as for the front legs.

On the upper side of each of a pair of the mount portions of each of the chairs 1*a* and 1*b*, a back plate 13 bent along the circumferential direction of the corresponding seat portion 2*a* and 2*b* is provided so as to be angled in a range of about 90 degrees in the circumferential direction of the corresponding seat portion 2*a* or 2*b*.

Figure 3A:
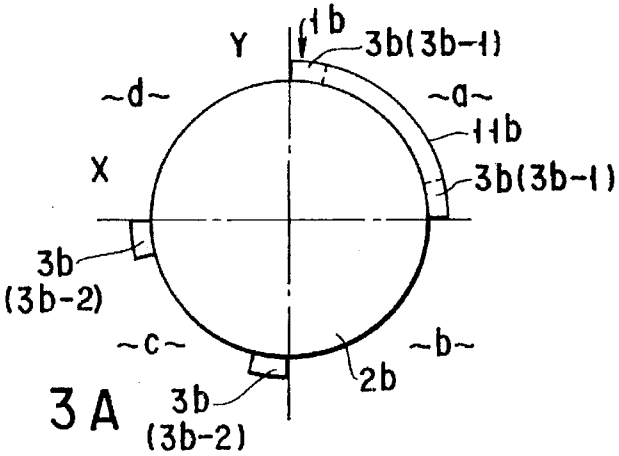
FIGS. 3A and 3B show the second chair.
Figure 2A:
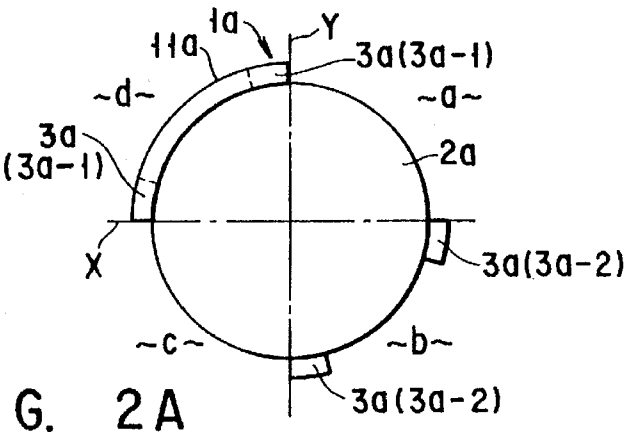
FIGS. 2A and 2B show the first chair.

With regard to four legs 3*a* and 3*b* of the first and second chairs 1*a* and 1*b*, two rear legs 3*a*-1 and 3*b*-1 and two front legs 3*a*-2 and 3*b*-2 are placed to be located on both ends of the circumferential direction within two regions which point symmetrical, in the case where each of the disk-shaped seat portions 2*a* and 2*b* is divided into four areas a to d by two lines X and Y normally crossing with each other as shown in FIGS. 2A and 3A.

Figure 3B:
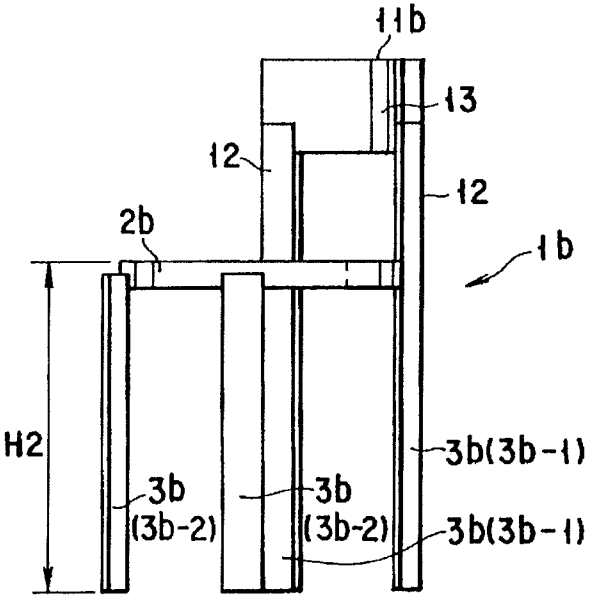

The arrangement of the four legs 3*a* and 3*b* of the first chair 1*a* is the same as that of the second chair 1*b*. FIGS. 3A and 3B show the state with reference to that shown in FIGS. 2A and 2B, that is, FIGS. 3A and 3B illustrate that the second chair 1*b* is rotated by 90 degrees with respect to the first chair 1*a*.

When the two rear legs 3*a*-1 of the first chair 1*a*are located in the area d as shown in FIG. 2A, the front legs 3*a*-2 are automatically located in the area b, whereas when the two rear legs 3*b*-1 of the second chair 1*b* are located in the area a as shown in FIG. 3A, the front legs 3*b*-2 are automatically located in the area c.

Figure 2B:
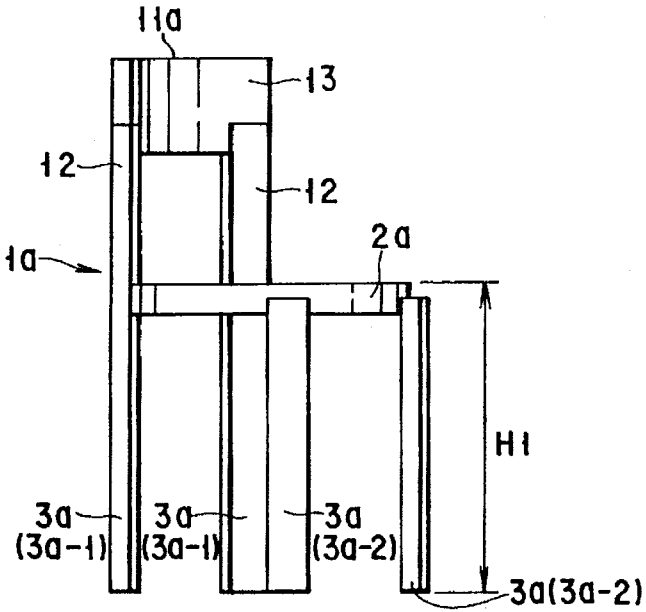
Figure 4A:
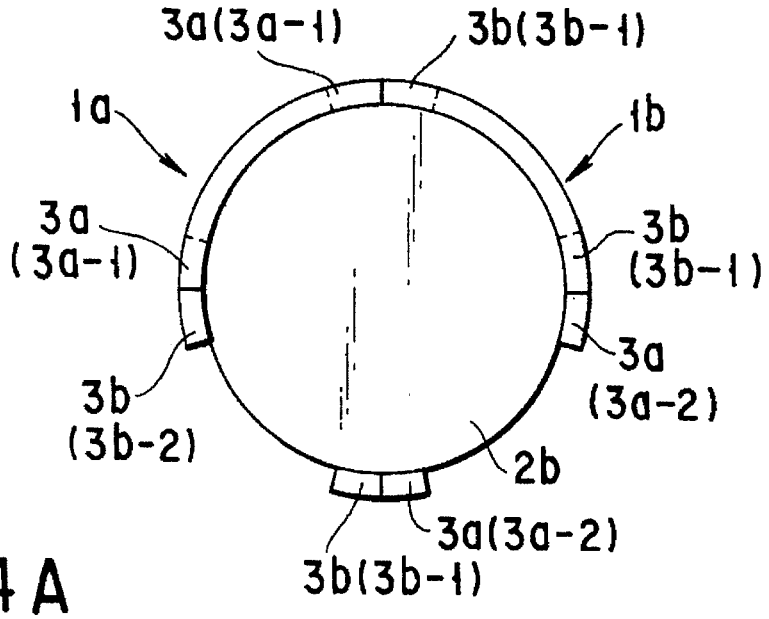
FIGS. 4A and 4B show the first and second chairs combined.
Figure 4B:
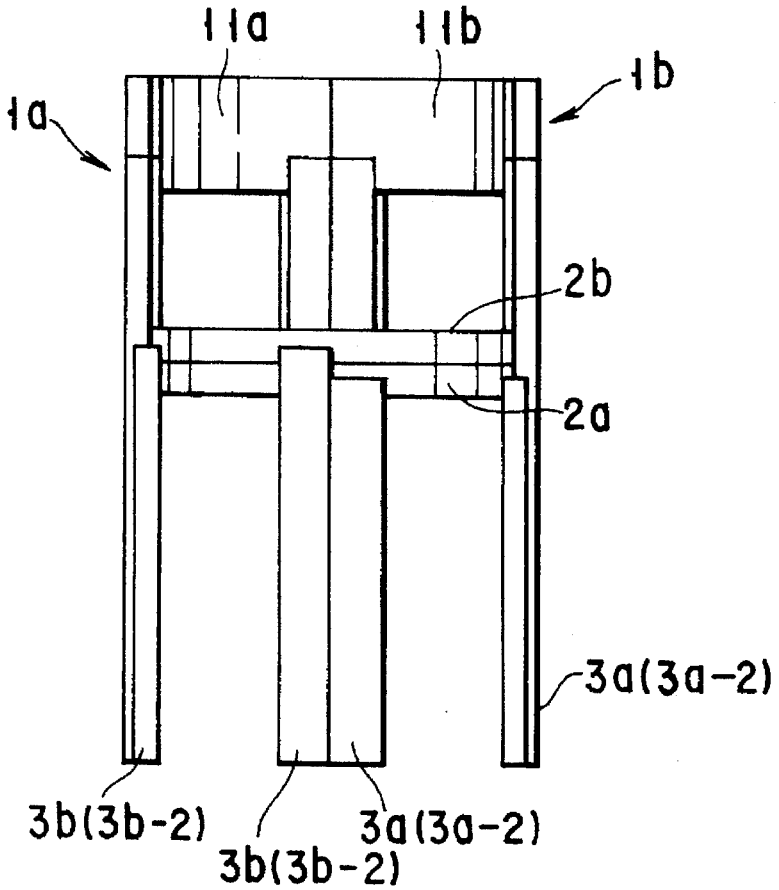

The first and second chairs 1*a* and 1*b* differ from each other in the height of supporting each of the seat portions 2*a* and 2*b*. More specifically, as shown in FIG. 2B and FIG. 3B, where H1 represents the height of the seat portion 2*a* of the first chair 1*a*, and H2 represents the height of the seat portion 2*b* of the second chair 1*b*, the relationship therebetween is H1<H2. The measurements of the supporting members 7 of the legs 3*a* and 3*b* of the first and second chairs 1*a*and 1*b* are determined so that the difference in height (H2–H1) is substantially the same as the thickness of the seat portion 2*b* of the second chair 1*b*.

With regard to the backrests 11*a* and 11*b* of the first and second chairs 1*a* and 1*b*, the lengths of the mount portions 12 are determined so that the upper ends of the back plates 13 of the chairs 1*a* and 1*b* are leveled. More specifically, the length of the mount portion 12 of the first chair 1*a* is set larger than that of the mount portion 12 of the second chair portion 1*b* by the thickness of the seat portion 2*b* of the second chair 1*b*.

According to the combination chair having the above-described structure, each of the first chair 1*a* and the second chair member 1*b* can be independently used as a chair. For example, when two pairs of combination chairs are prepared, four chairs can be used for four people.

In contrast, when the number of users reduces from four to two, each of the first chairs 1a is stacked upon the corresponding one of the second chairs 1*b*, thus reducing the number of chairs from four to two.

Figure 1A:
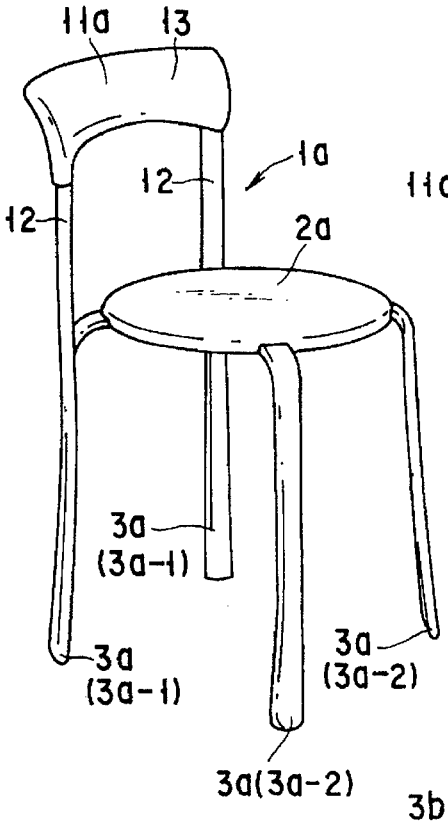
FIGS 1A, 1B and 1C are perspective views of a combination chair according to the first embodiment of the present invention, FIG. 1A being a perspective view showing a first chair, FIG. 1B being a perspective view showing the first and second chairs while being stacked up, and FIG. 1C being a perspective view showing the first and second chairs which have been stacked up.
Figure 1B:
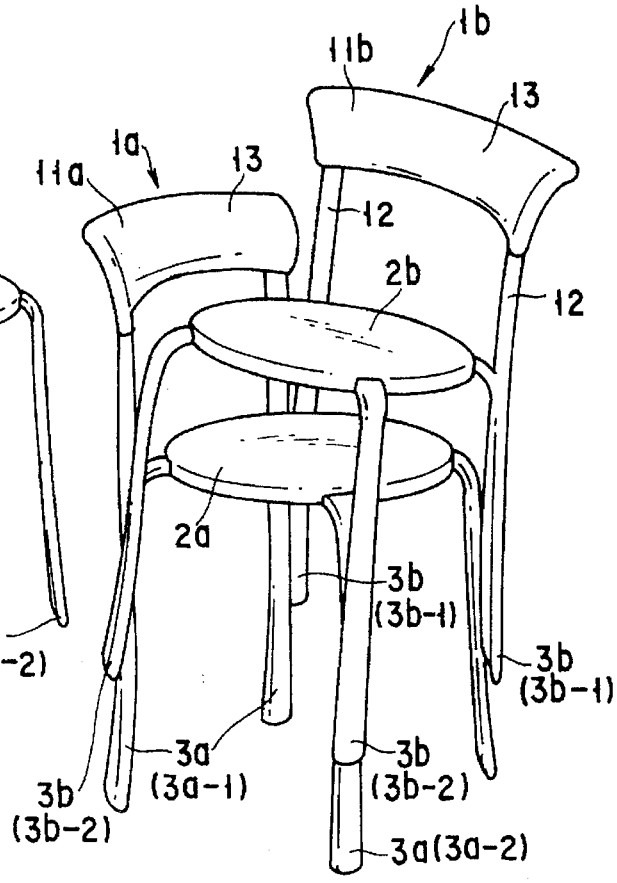
Figure 1C:
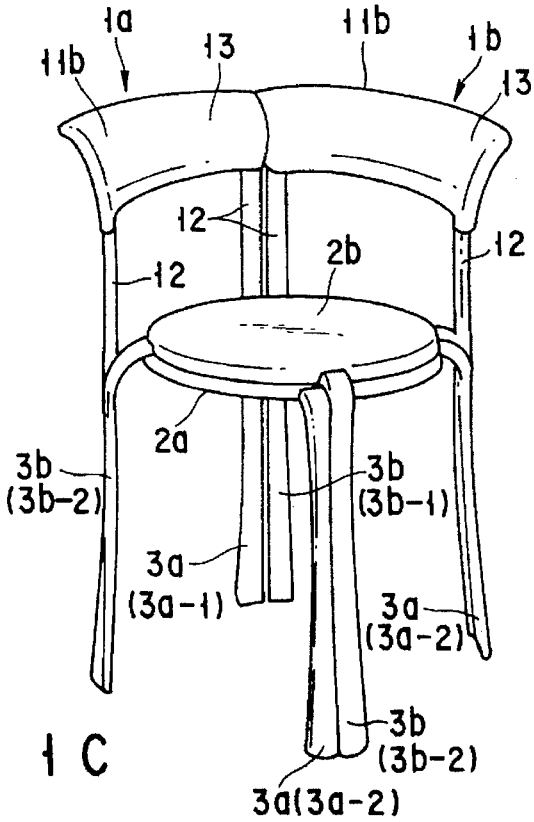

More specifically, as shown in FIGS. 1B, 2A and 3A, the seat portion 2*b* of the second chair 1*b* is stacked upon the seat portion 2*a* of the first chair member 1*a* in such a manner that the seat portion 2*b* is rotated by 90 degrees in the clockwise direction with respect to the seat portion 2*a*. With this operation, the backrest 11*a* of the first chair 1*a* and the backrest 11*b* of the second seat portion 1*b* are placed adjacent to each other with one end of the backrest 11*a* being in contact with one end of the backrest 11*b*, thus surrounding a part of the seat portions 2*a* and 2*b* in a range of 180 degree in the circumferential direction. Therefore, the two backrests 11*a* and 11*b* appear to be one backrest as a whole.

Further, one of the front legs 3*b*-2 of the second chair 1*b* is placed to be adjacent to and in contact with one of the front legs 3*a*-2 of the first chair la, and the other front legs 3*a*-2 and 3*b*-2 are placed to be adjacent to and in contact with one of the rear legs 3*b*-1 of the second chair 1*b* and one of the rear legs 3*a*-1 of the first chair la, respectively. The two legs placed to be in contact with and adjacent to each other have an appearance of one leg, and such a structure is good in appearance.

As described above, with a structure in which the backrests 11*a* and 11*b* and the front and back legs 3*a* and 3*b* are placed to be adjacent to and in contact with each other, the second chair 1*b* is prevented from rotating with respect to the first chair *a* in the circumferential direction, and thus the first chair is integrally stacked upon the second chair.

When the lower surface of the seat portion 2*b* of the second chair 1*b* is stacked upon the upper surface of the seat portion 2*a* of the first chair la, the lower ends of the legs 3*a* and 3*b* of these chairs are located at the same position, more specifically, to coincide with each other. With this structure, the legs 3*a* and 3*b* of both chairs 1*a* and 1*b* are grounded on the floor, and therefore the stacked two chairs 1*a* and 1*b* are not rendered loose, since the second chair 1*b* whose seat portion 2*b* is placed on the upper side, is not set unstable.

Further, the joint portions 6 of the rear legs 3*a*-1 and 3*b*-1 and the front legs 3*a*-2 and 3*b*-2 are embedded in the grooves 4, and the support portions 7 are rendered to project from the outer circumferences of the seat portions 2*a* and 2*b*. With this structure, these legs do not project from the lower surfaces of the seat portions 2*a* and 3*b*. Consequently, when the lower surface of the seat portion 2*b* of the second chair 1*b* is stacked upon the upper surface of the seat portion 2*a* of the first chair 1*a*, these seat portions can be accurately jointed together without looseness.

As described above, the combination chair of the present invention is not simply a chair formed by stacking the first chair 1*a* upon the second chair 1*b*, but the combination chair has an appearance as if it is one chair, with the structure in which the seat portions 2*a*, 2*b*, the legs 3*a* and 3*b*, and the backrests 11*a* and 11*b* are jointed up to down and side to side. Therefore, even if two chairs 1*a* and 1*b* are used as one chair, the appearance of such a combination chair is natural, and in fact, excellent, and the combination chair can be easily used.

Further, with the structure in which the two backrests 11*a* and 11*b* are jointed side by side, the two backrests can be used not only as a backrest, but also as an armrest.

Figure 8A:
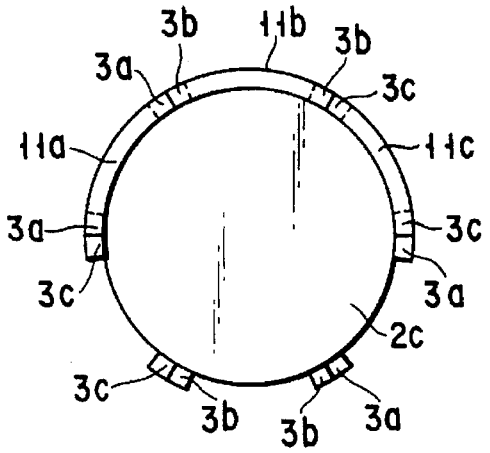
FIGS. 8A and 8B show a modified version of the first embodiment.
Figure 8B:
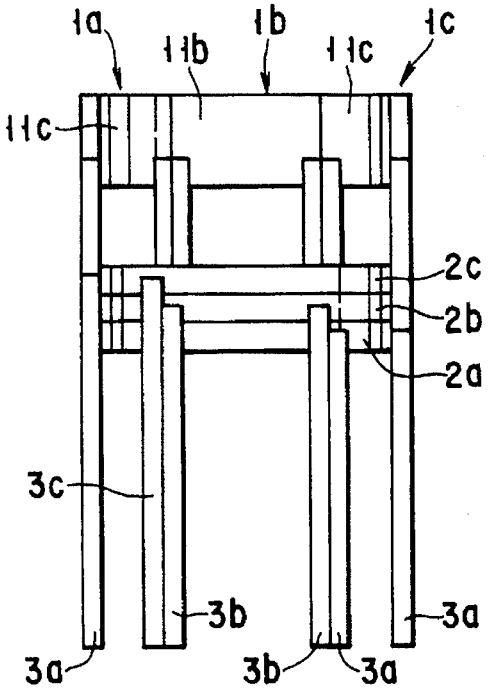

FIG. 8 shows a remodeled version of the first embodiment. In this version, first to third chairs 1*a*, 1*b* and 1*c* are stacked up into one combination chair. In the following description, structural elements of the first and second chairs 1*a* and 1*b*, which are the same as those of the above-described first embodiment, are designated by the same reference numerals, and a seat portion, legs and a backrest of the third chair 1*c* are designated by 2*c*, 3*c* and 11*c*, respectively.

In order to achieve the following constitution of the three chairs 1*a* to 1*c*, the chairs are formed as described as follows. That is, the lengths of the legs 3*b* and 3*c* of the second and third chairs 1*b* and 1*c* are determined so that the legs 3*b* and 3*c* are both grounded when the seat portions 2*a* to 2*c* of the chairs 1*a* to 1*c* are stacked up together. The backrests 11*a* to 11*c* are formed so that they are leveled at the same height when the chairs are stacked up together. Further, the three backrests 11*a* to 11*c* are formed so that they cover a range of about 180 degrees of the outer circumferences of the seat portions 2*a* to 2*c*, with each backrest covering a range of 60 degrees in the circumferential direction of its seat portion, when the three backrests 11*a* to 11*c* are placed adjacent to each other.

With the above-described constitution, the number of chairs can be changed from one to three or vice versa, in accordance with a change in the number of users, and therefore the range of usage is further expanded as compared to the case where two chairs are combined, thus increasing the utility of the chair combination.

In the above first embodiment, the description was provided in connection with the case where the seat portions of chairs are of a round shape; however the seat portions may be of a shape other than a round type, such as a rectangular type including square or a hexagonal type.

FIGS. 9 to 14 show the second embodiment of the present invention. The combination chair of the second embodiment comprises two chairs, more specifically, a first chair (main chair) 21*a* and a second chair (sub-chair) 21*b*, which appear to be substantially the same, but are different from each other in shape (measurements).

The first and second chairs 21*a* and 21*b* have rectangular seat portions 22*a* and 22*b* having different sizes from each other. More specifically, the seat portion 22*a* of the first chair 21*a* is formed in a rectangular shape which is larger than the size of the seat portion 22*b* of the second chair 21*b*.

Figure 10:
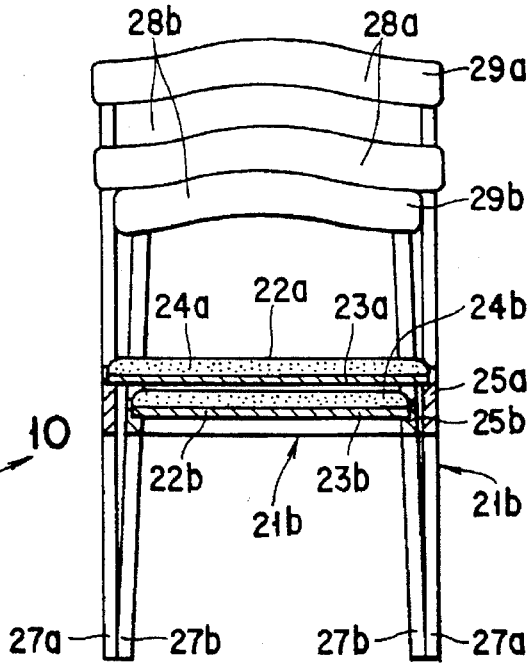
FIG. 10 is a cross section of the combination chair taken along the line 10—10 in FIG. 9C.
Figure 11:
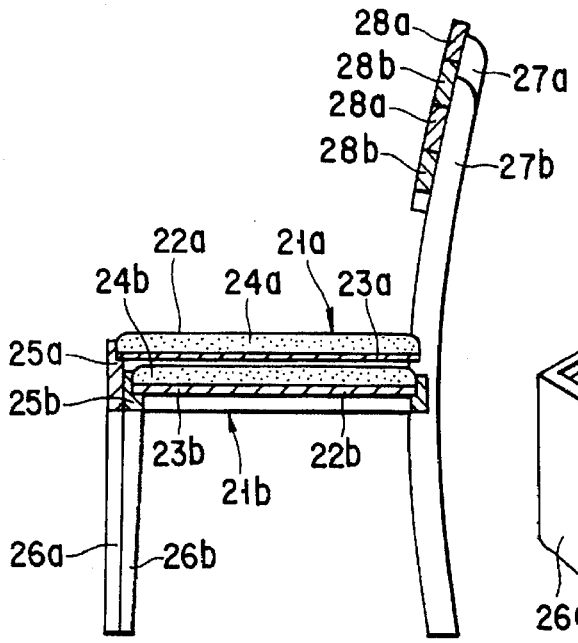
FIG. 11 is a cross section of the combination chair taken along the line 11—11 in FIG. 9C.
Figure 12:
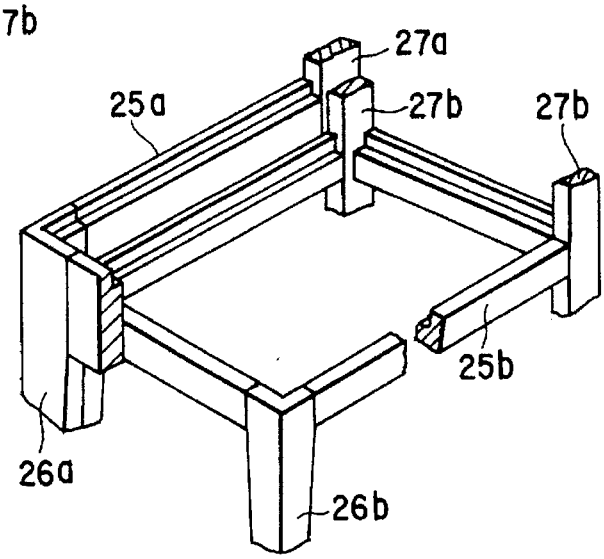
FIG. 12 is a perspective view showing a portion of seat portions of the two chairs combined, a part of which is cutaway.

As shown in FIGS. 10 and 11, the seat portions 22*a*and 22*b* comprise frame bodies 25*a* and 25*b* in which cushion members 24*a* and 24*b* are provided on the upper surfaces of rectangular seat plates 23*a* and 23*b*, and the circumference excluding the back surfaces of the seat plates 23*a* and 23*b* are covered from three directions; two pairs of front legs 26*a* and 26*b*, the upper ends of which are jointed to the two corner portions on the front end sides of the seat portions 22*a* and 22*b*; two pairs of rear legs 27*a* and 27*b*, the mid-portions of which are jointed to the corner portions of the rear end sides of the seat portions 22*a* and 22*b*; and backrests 29*a* and 29*b* formed by providing two back plates 28*a* and 28*b* on the portions of the rear legs 27*a* and 27*b*, which project from the upper surfaces of the seat portions 22*a* and 22*b*, in the vertical direction at a predetermined interval.

The seat portion 22*a* of the first chair 21*a* is formed and set at a predetermined height so that the seat portion can be stacked upon the upper surface side of the seat portion 22*b* of the second chair 21*b*. More specifically, the lengths of these legs and the height at which the seat portions 22*a* and 22*b* are supported are determined so that the front legs 26*a* and rear legs 27*a* of the first chair 21*a* are grounded when the seat portion 22*a* of the first chair 21*a* is stacked upon the upper surface side of the seat portion 22*b* of the second chair 21*b*.

Figure 13:
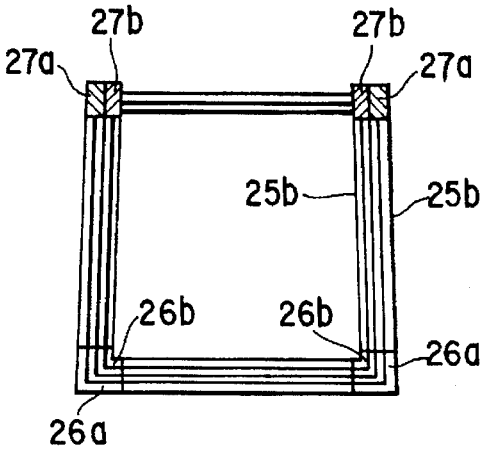
FIG. 13 is a cross section of the seat portion of the combination of the two chairs.
Figure 14:
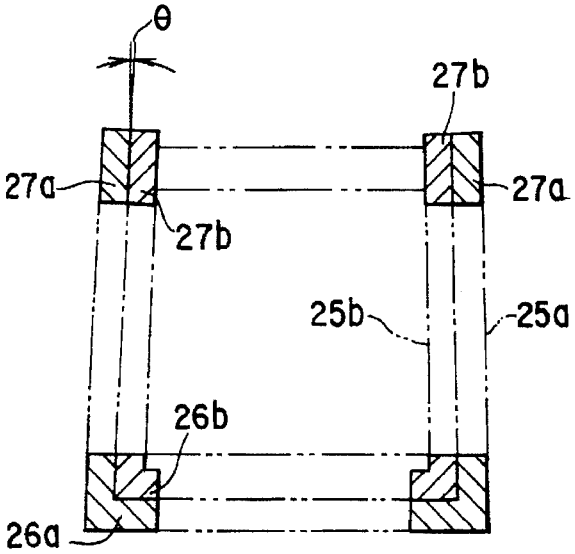
FIG. 14 is an explanatory view illustrating the state of the front leg and rear leg of the combination chair.

Both sides of the frame portions 25*a* and 25*b* of the seat portions 22*a* and 22*b* are tilted so that the width between both sides is decreased from the front end to the rear end as shown in FIGS. 13 and 14. The angle of tilt is expressed by 8. With this structure, the movement of the second chair 21*b* is integrally associated with the movements of the first chair 21*a* in the front and rear directions when the seat portion 22*b* of the second chair 21*b* is stacked upon the seat portion 22*a* of the first chair 21*a*. In other words, the second chair 21*b* is prevented from moving separately from the first chair 21*a*.

Each of the two front legs 26*a* of the first chair 21*a* and the two front legs 26*b* of the second chair 21*b* has an L-shaped cross section as shown in FIG. 14. The measurement between the outer surfaces of the two front legs 26*b* of the second chair 21*b* is set slightly smaller than the measurement between the inner surfaces of the two front legs 26*a* of the first chair 21*a*.

Each of the two rear legs 27*a* of the first chair 21*a* and the two rear legs 27*b* of the second chair 21*b* has a strap-shaped cross section as shown in FIG. 14. The measurement between the outer surfaces of the two front legs 26*b* of the second chair 21*b* is set slightly smaller than the measurement between the inner surfaces of the two front legs 26*a* of the first chair 21*a*.

Therefore, when the first chair 21*a* is stacked upon the second chair 21*b*, the front legs 26*b* and rear legs 27*b* of the second chair 21*b* are placed at positions to engage with the inner surfaces of the front legs 26*a* and the rear legs 27*a* of the first chair 21*a*. Thus, the second chair 21*b* is combined with the first chair 21*a* without being shaky in the lateral direction.

The depth of the first chair 21*a* is set slightly larger than the depth of the second chair 21*b*. With this structure, when the first chair 21*a* is stacked upon the second chair 21*b*, a pair of the rear legs 27*b* of the second chair 21*b* are fitted between a pair of the rear legs 27*a* of the first chair 21*a*.

Figure 9A:
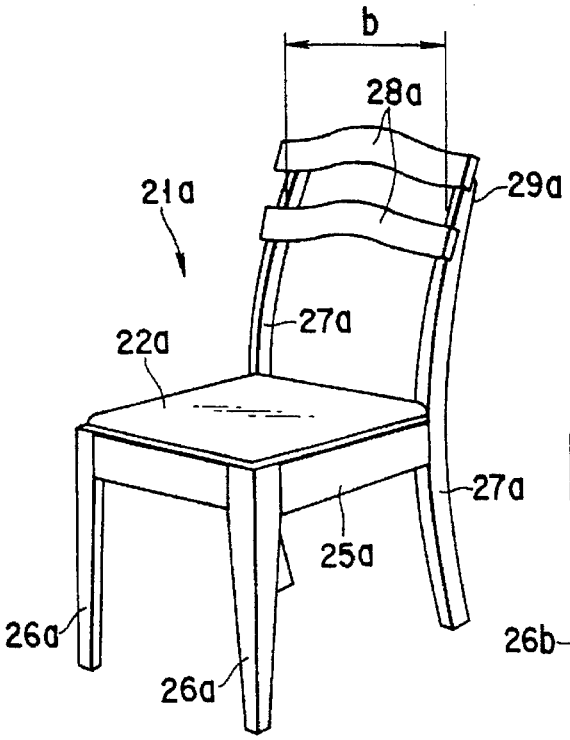
FIGS. 9A, 9B and 9C are perspective views of a combination chair, according to the second embodiment of the present invention, FIG. 9A being a perspective view showing a first chair, FIG. 9B being a perspective view showing a second chair, and FIG. 9C being a perspective view showing the first and second chairs when they have been combined together.
Figure 9B:
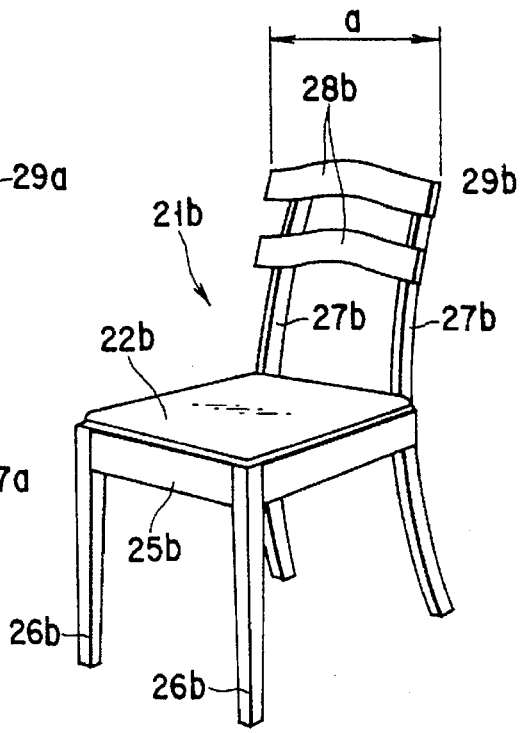

As shown in FIGS. 9A and 9B, the width a of the back plates 28*b* of the second chair 21*b* is set slightly smaller than the width b of the portions of the pair of the rear legs 27*a* of the first chair 21*a*, which project upward from the seat portion 22*a*, on which the backrest 29*a* is formed.

As the pair of the rear legs 27*b* of the second chair 21*b* are fitted between the inner sides of the pair of the rear legs 27*a* of the first chair 21*a*, the back plates 28*b* of the second chair 21*b* are also fitted between the rear legs 27*a* of the backrests 29*a* of the first chair 21*a*. Therefore, as shown in FIG. 11, the back plates 28*a* of the first chair 21*a* and the back plates 28*b* of the second chair 21*b* coincide substantially with each other in terms of the front-rear direction, that is, the back plates are flush with each other and the back plates 28*a* of the first chair 21*a* are engaged with the back plates 28*b* of the second chair 21*b* in the up-and-down direction.

According to the combination chair having the above-described structure, each of the first chair 21*a* and the second chair 21*b* can be used separately as a chair. For example, with two pairs of combination chairs, four people can use four chairs.

When the number of users decreases from four to two, four chairs can be set into two chairs by stacking the first chair 21*a* of each pair upon the second chair 21*b*.

Figure 9C:
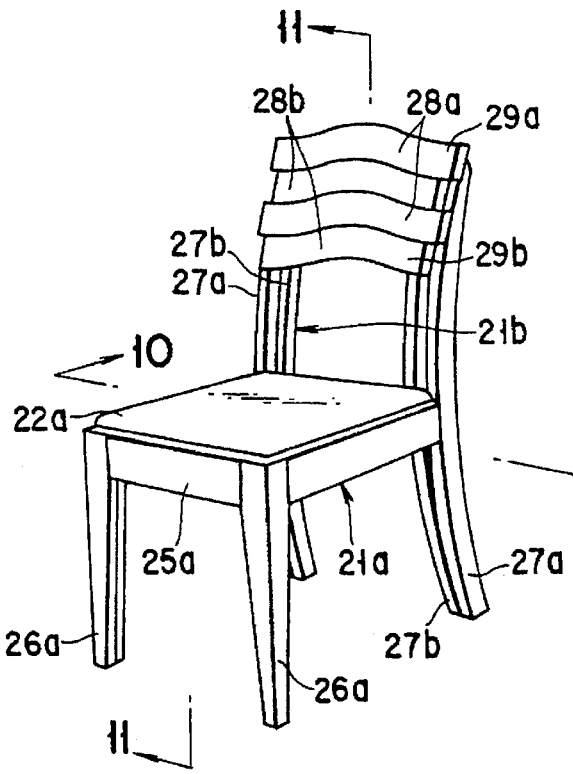

As shown in FIGS. 9C, 10 and 11, the seat portion 22*a* of the first chair 21*a* is stacked upon the seat portion 22*b* of the second chair 21*b*. With this operation, two chairs, namely the first and second chairs 21*a* and 22*b* are combined into one chair. Further, the front legs 26*b* and the rear legs 27*b* can be set in the inner sides of the front legs 26*a* and the rear legs 27*a* of the first chair 21*a*, and the back plates 28*b* of the backrest 29*b* of the second chair 21*b* can be engaged with the back plates 28*a* of the backrest 29*a* of the first chair 21*a* in the up-and-down direction. Furthermore, as the seat portions 22*a* and 22*b* are stacked one upon the other, they are integrally combined with each other.

With the above-described structure and operation, not only the first chair 21*a* and the second chair 21*b* can be combined into one chair, but also they are integrated with each other and a shaky movement thereof in the width direction or the front-rear direction, or even the up-and-down direction can be prevented. Consequently, such a combination chair can be easily used as one chair.

Moreover, since the front legs 26*a* and the rear legs 27*b* of the second chair 21*b* are fitted between the inner sides of the front legs 26*a* and the rear legs 27*a* of the first chair 21*a*, these legs exhibit an appearance of integrated sets. Also, the seat portion 22*b* of the second chair 21*b* is covered by the seat portion 22*a* of the first chair 21*a*, and the backrest 29*a* of the first chair 21*a* and the backrest 29*b* of the second chair 21*b* exhibit an appearance of integrated sets as the back plates 28*a* and 28*b* are flushed with each other. Therefore, the two chairs, namely, the first and second chairs 21*a* and 21*b* set in combination exhibit an excellent appearance as if they are one chair.

In order to separately use the two chairs 21*a* and 21*b* set in combination as shown in FIGS. 10 and 11, the first chair 21*a* is held upward to release the combination state with the second chair 21*b*, thus separating these chairs from each other.

FIGS. 15 to 18 show the third embodiment of the present invention. The difference between this embodiment and the second embodiment can be identified by comparing the backrest structures of the first chair 1*a* and the second chair 1*b* of this embodiment with those in the second embodiment. Structural elements of this embodiment, which are the same as those of the second embodiment, are designated by the same reference numerals, and the explanations therefor will be omitted.

Backrests 39*a* and 39*b* of chairs 21*a* and 21*b* of this embodiment are formed by setting back plates 38*a* and 38*b* on the upper portions of rear legs 27*a* and 27*b*, respectively. With this structure, when the first chair 21*a* and the second chair 21*b* are combined together, the backrest 39*a* of the second chair 21*b* is jointed to the back surface side of the backrest 39*a* of the first chair 21*a* as shown in FIG. 16, and the backrest 39*b* of the second chair 21*b* is fitted in the backrest 39*a* of the first chair 21*a* inwardly in the width direction of the backrest 39*a* as shown in FIG. 18.

With the engagement between the backrests 39*a* and 39*b*, the width directional movement of the first chair 21*a* and the second chair 21*b* is limited. The up-and-down directional movement of the pair of the chairs 21*a* and 21*b* can be limited by integrally jointing the seat portions 22*a* and 22*b* of the combined first and second chairs 21*a* and 21*b*, with a cover 31, as shown in FIG. 17.

The cover 31 has a rectangular bag-like structure having an open lower surface, made of a material formed by covering a seat-like cushion material with fabric, and a first velvet fastener 32 is set on the lower end portion of each side of the cover. In contrast, a second velvet fastener (not shown) to be engaged with the first velvet fastener 32 is set on the inner surface of a frame body 23*b* of the seat portion 22*b* of the second chair 21*b*.

With this structure, as shown in FIG. 16, after the first chair 21*a* and the second chair 21*b* are combined together, the seat portion 22*a* of the first chair 21*a* is covered by the cover 31, and the first velvet fastener 32 provided at the lower end of each side is engaged with the second velvet fastener provided on the inner surface of the seat portion 22*b* of the second chair 21*b*, thus integrally combining the first chair 21*a* and the second chair 21*b*. Therefore, the movement not only in the up-and-down direction, but also in the horizontal direction, can be suppressed. Further, the two seat portions 22*a* and 22*b* covered by the cover 31 have an appearance as if it is one seat portion, and therefore exhibit a natural appearance.

FIG. 19 is a remodeled version of the second embodiment. The second embodiment was described in connection with the case where two chairs are combined; however this version is directed to a combination chair in which first to third chairs 21*a*, 21*b* and 21*c* are stacked up together.

This version will now be described with reference to FIG. 19. The same structural elements as those of the second embodiments are designated by the same reference numerals, and the seat portion of the third chair 21*c* is denoted by 22*c*, the front legs are denoted by 26*c*, the rear legs by 27*c* and the backrest by 29*c*.

In the case of the structure in which three chairs 21*a* to 21*c* can be combined together, the lengths of the front legs 26*a*, 26*b* and 26*c* and the rear legs 27*a*, 27*b* and 27*c* are determined so that each of these legs are grounded when the seat portions 22*a* to 22*c* of the chairs 21*a* to 21*c* are stacked up, and the widths of the backrests 39*a* to 39*c* are determined so that the back plates 28*a* to 28*c* are fitted with each other in the up-and-down direction, being flush with each other, as in the second embodiment.

With the above-described structure, the number of chairs used can be changed to one, two or three in accordance with an increase/decrease in the number of users. Therefore, the range of use is expanded as compared to the case where two chairs are combined, thus increasing the utility.

FIGS. 20A to 20D show the fourth embodiment of the present invention. This embodiment is substantially the same as the first embodiment except for the following points. That is, the cross sections of the front legs 26*a* and 26*b* and the rear legs 27*a* and 27be of the first chair 21*a* and the second chair 21*b* have strip-like (rectangular) shapes, and each pair of front legs 26*a* and 26*b* are arranged so that the front end sides thereof are tilted inwardly in the width direction, and each pair of rear legs 27*a* and 27*b* are arranged in parallel with each other in the front-to-rear direction, as shown in FIG. 20D.

With the above structure, when the first chair 21*a* and the second chair 21*b* are combined together, the outer surfaces of the front legs 26*b* and the rear legs 27*b* of the second chair 21*b* are jointed to the inner surfaces of the front legs 26*a* and the rear legs 27*a* of the first chair 21*a*. Thus, the shaky movement of the second chair 21*b* in the right-to-left direction and the front direction with respect to the first chair 21*a* is suppressed.

FIGS. 21A to 21K are cross-sections illustrating a state in which the front legs 26*a* of the first chair 21*a* are engaged with the front legs 26*b* of the second chair 21*b*. As shown in these figures, the front legs can be arranged to have various shapes in cross section.

Figure 21A:
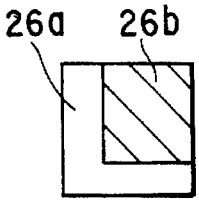
Figure 21B:
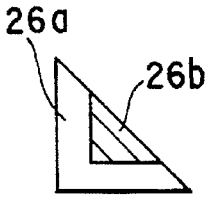
Figure 21C:
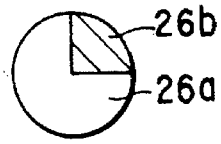
Figure 21D:
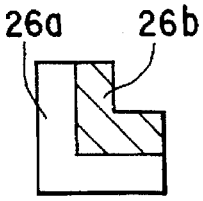
Figure 21E:
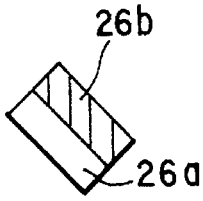
Figure 21F:
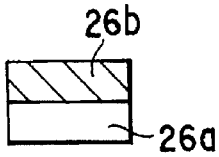
Figure 21G:
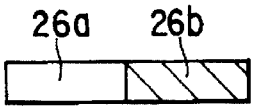
Figure 21H:
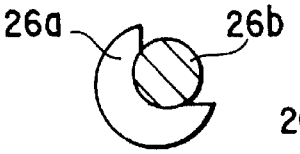
Figure 21I:
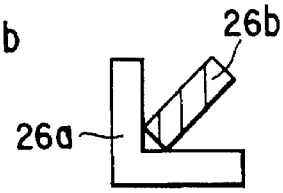
Figure 21J:
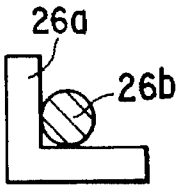
Figure 21K:
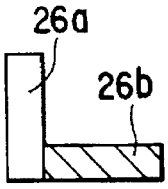

Of FIGS. 21A to 21K, those except for the version shown in FIG. 21G show the cases where the front legs 26*b* of the second chair 21*b* are engaged with the inner sides, in terms of the width direction, of the front legs 26*a* of the first chair 21*a*. Thus, the width-directional shaky movement of the two combined chairs 21*a* and 21*b* can be suppressed. In contrast, the version shown in FIG. 21G is directed to the case where the front legs 26*b* of the second chair are located on the rear sides, in terms of the front-rear direction, of the front legs 26*a* of the first chair 21*a*. Thus, the shaky movement of the combined two chairs 21*a* and 21*b* in the front-rear direction is suppressed.

The second to fourth embodiments were described in connection with the case where the seat portion of the chair is of a square shape; however the seat portion may be of a shape other than square, such as a round shape.

FIGS. 22 to 24 show the fifth embodiment of the present invention.

A combination chair of this embodiment comprises two chairs, namely, a first chair (main chair) 41*a* and a second chair (sub-chair) 41*b*, which differ from each other in appearance and shape (measurements), as shown in FIGS. 22A and 22B.

The first chairs 41*a* and 41*b* respectively include rectangular seat portions 42*a* and 42*b* which are different from each other in size. More specifically, the seat portion 42*a* of the first chair 41*a* has a rectangular shape whose width is larger than and whose length is about the same as that of the seat portion 42*b* of the second chair 41*b*.

The seat portions 42*a* and 42*b* are formed by providing cushion members 44*a* and 44*b* on the upper surfaces of rectangular seat plates 43*a* and 43*b*, respectively, as shown in FIGS. 23 and 24. Two front legs 46*a* and 46*b* are jointed by their upper end portions to two corners of the front end side of each of the seat portions 42*a* and 42*b*, and two rear legs 47*a* and 47*b* which are connected to each other by their mid portions, are jointed to two corner portions of the rear end side.

The portion of the rear legs 47*a* of the first chair 41*a*, which project upward from the seat portion 42*a*, is formed into a frame-like backrest 49*a*. A cushion member 50 is provided via a back plate 51 on the front surface of the portion of the rear legs 47*b* of the second chair 41*b*, which project upward from the seat portion 42*b*, thus forming a rectangular backrest 49*b*. The size of the backrest 49*b* of the second chair 41*b* is determined so as to fit to the frame of the backrest 49*a* of the first chair 41*a*. Across the portions of the pair of the rear legs 47*b*, which correspond to the lower end portion of the back plate 51, a lateral bar 52 is bridged so as to reinforce the back plate 51 as shown in FIG. 24.

The size and height of the seat portion 42*a* of the first chair 41*a* are set so that it can be stacked upon the upper surface side of the seat portion 42*b* of the second chair 41*b*. More specifically, the heights for the seat portions 42*a* and 42*b*, that is, the lengths of the legs, are determined so that the front legs 46*a* and rear legs 47*a* of the first chair 41*a* are grounded on the floor when the seat portion 42*a* of the first chair 41*a* is stacked upon the upper surface side of the seat portion 42*b* of the second chair 41*b*.

Each of the two front legs 46*a* of the first chair 41*a* and the two front legs 46*b* of the second chair 41*b* has a rectangular shape in cross section, that is, a stripe shape, as shown in FIGS. 22A to 22C. The measurement between the outer surfaces, in terms of the width direction, of the two front legs 46*b* of the second chair 41*b* is set slightly smaller than that between the inner surfaces, in terms of the width direction, of the two front legs 46*a* of the first chair 41*a*.

Each of the two rear legs 47*a* of the first chair 41*a* and the two rear legs 47*b* of the second chair 41*b* has a rectangular shape in cross section as in the front legs. For these rear legs, the measurement between the outer surfaces, in terms of the width direction, of the two rear legs 47*b* of the second chair 41*b* is set slightly smaller than that between the inner surfaces of the two rear legs 47*a* of the first chair.

Therefore, when the first chair 41*a* is stacked upon the second chair 41*b*, the front legs 46*b* and the rear legs 47*b* of the second chair 41*b* are engaged with the inner sides of the front legs 46*a* and the rear legs 47*a* of the first chair 41*a*, and the backrest 49*b* of the second chair 49*b* is set in the frame of the backrest 49*a* of the first chair 41*a* so that the cushion 50 of the second chair protrudes to the front surface side. Thus, the second chair 1*b* can be combined with the first chair 1*a* without being loose.

According to such a combination chair having the above-described structure, each of the first and second chairs 41*a* and 41*b* can be separately used as a chair. For example, when two pairs of combination chairs are prepared, four people can sit on four chairs.

When the number of users decreases from four to two, the number of chairs can be reduced from four to two by stacking up the first and second chairs 41*a* and 41*b* of each pair together.

More specifically, as shown in FIGS. 22A, 23 and 24, the seat portion 42*a* of the first chair 41*a* is stacked upon the seat portion 42*b* of the second chair 41*b*. With this operation, the two chairs, namely, the first and second chairs 41*a* and 41*b* can be combined into one chair. Further, the front legs 46*b* and the rear legs 47*b* of the second chair 41*b* are placed on the inner sides, in terms of the width direction, of the front legs 46*a* and the rear legs 47*a* of the first chair 41*a*, and the backrest 49*b* of the second chair 41*b* is fitted in the frame of the backrest 49*a* of the first chair 41*a*.

Therefore, not only the first chair 41*a* and the second chair 41*b* are combined into one chair, but also they are integrated as a combined body without being loose. Thus, the combination chair can be easily used.

Further, with the structure in which the front legs 46*b* and the rear legs 47*b* of the second chair 41*b* are set in the inner sides, in terms of the width direction, of the front legs 46*a* and the rear legs 47*a* of the first chair 41*a*, these legs have an appearance as if they are integrated as each pair. Also, as the backrest 49*b* of the second chair 41*b* is set in the frame of the backrest 49*a* of the first chair 41*a*, these backrests exhibit an appearance of an integrated member. Consequently, the combined two chairs can be easily used as one chair. Furthermore, in the combination state, the cushion 50 of the backrest 49*b* of the second chair 41*b* protrudes to the front surface side of the backrest 49*a* of the first chair 41*a*, and therefore the user can lean on the cushion 50.

With regard to the fifth embodiment, the front legs 46*a* of the first chair 41*a* and the front legs 46*b* of the second chair 41*b* may be formed to have a shape in cross section and an arrangement as shown in any one of FIGS. 21A to 21K.

The fifth embodiment was described in connection with the case where the seat portion of the chair has a square shape; however the shape of the seat portion may be round, or of that other than square, such as rectangular.

FIGS. 25 to 27 show the sixth embodiment of the present invention.

A combination chair of this embodiment consists of a first chair 61*a* and a second chair 61*b*, which are substantially similar to each other in the shape of appearance.

The first and second chairs 61*a* and 61*b* have seat portions 62*a* and 62*b* made of substantially rectangular plate members having sizes different from each other. More specifically, the seat portion 62*a* of the first chair 61*a* has a rectangular shape larger than that of the seat portion 62*b* of the second chair 61*b*.

Two front legs 63*a* and two front legs 63*b* are provided at two corner portions of the front end sides of the seat portions 62*a* and 62*b*, respectively, and two front legs 64*a* and two front legs 64*b* are provided at corner portions of the rear end sides. The distance between the inner sides of a pair of the rear legs 64*b* of the second chair 61*b* is set slightly smaller than the distance between the outer sides of a pair of the rear legs 64*b* of the first chair 61*a*.

The seat portion 62*b* of the second chair 61*b* is set at such a height that it is fitted under the lower surface side of the seat portion 62*a* of the first chair 61*a*. With this structure, the upper surface of the seat portion 62*b* of the second chair 61*b* is jointed to the lower surface of the seat portion 62*a* of the first chair 61*a*. The lengths of the front legs 63*a* and the rear legs 64*a* of the first chair 61*a* are determined so that the lower ends thereof are grounded on the floor without floating. Therefore, when the first chair 61*a* and the second chair 61*b* are combined together, these chairs are not loose.

Each of the front legs 63*a* of the first chair 61*a* has a semi-circular shape in cross section, and each front leg is arranged so that the flat surface side thereof opposes to the rear leg 64*a* located in a diagonal direction of the seat portion 62*a*. Each of the front legs 63*b* of the second chair 61*b* has a slender rectangular shape in cross section, and is arranged so that the longitudinal direction thereof faces in the diagonal direction of the seat portion 62*b*.

The portions of the rear legs 64*a* and 64*b* of the chairs 61*a* and 61*b*, which project upward from the seat portions 62*a* and 62*b* are respectively formed into arch-shaped backrests 65*a* and 65*b*. The size of the backrest 65*b* of the second chair 61*b* is determined so that the backrest is fitted in the arch of the backrest 65*a* of the first chair 61*a* as shown in FIG. 25. In the state in which the backrest is fitted in the arch, the shaky movement of the backrest 64*b* of the second chair 61*b* in the up-and-down and right-to-left directions can be suppressed by the backrest 65*a* of the first chair 61*a*.

A frame body 66*a* is provided on the lower surface of the seat portion 62*a* of the first chair 61*a* to cover three directions of the seat portion, excluding one side, which is the rear side, and similarly, a frame body 66*b* is provided on the lower surface of the seat portion 62*b* of the second chair 61*b* in three directions of the seat portion, excluding one side, which is the rear side.

The tip end sides of the front legs 63*n* of the second chair 61*b* protrude to the outer circumference of the frame body 66*b*. When the first chair 61*a* and the second chair 61*b* are combined together, the tip ends of the front legs 63*b* of the second chair 61*b* are brought into contact with the flat surfaces of the front legs 63*a* of the first chair 61*a*. With this structure, the shaky movement of the second chair 61*b* in the front-rear direction with respect to the first chair 61*a* can be suppressed.

According to the combination chair of the above-described structure, the first chair 61*a* and the second chair 61*b*, when they are combined, can be used as one chair.

The first chair 61*a* and the second chair 61*b* combined are integrated together as the backrest 64*b* of the second chair 61*b* is fitted in the backrest 64*a* of the first chair 61*a*, and these backrests exhibit an appearance as if they are one.

When the seat portions 62*a* and 62*b* of the two chairs are combined together, the shaky movement of the second chair 61*b* in the front-rear, right-to-left and up-and-down directions with respect to the first chair 61*a* is suppressed. Further, the front legs 63*a* and the rear legs 64*b* of the first chair 61*a* located on the upper side are surely grounded, and therefore, two chairs, if combined, are not loose as one chair and can be comfortably used.

FIGS. 28A to 29B show the seventh embodiment of the present invention.

A combination chair of the present invention consists of a first chair 71*a* and a second chair 71*b*. Seat portions 72*a* and 72*b* of the chairs 71*a* and 71*b* are made of rectangular boards having substantially the same size.

Mid portions of a pair of the front legs 73*a* is fixedly jointed to the front end locations of both sides of the seat portion 72*a* of the first chair 71*a*. The upper end portions of the front legs 73*a* are formed into armrests 74 which are bent towards the rear side substantially in an L-shape, and the rear end portions of a pair of the armrests 74 are formed into a backrest 75*a* arranged along with the width direction of the seat portion 72*a*. A back plate 76*a* is formed in such a manner that the upper and lower ends thereof are fixed to the mid portion of the backrest 75*a* and the rear end surface of the seat portion 72*a*, respectively. That is, the front legs 73*a*, the armrests 74 and the backrest 75*a* are integrally formed of one rod member made of metal or wood.

On both sides of the rear end portion of the seat portion 72*a*, the mid portions of rear legs 77*a* made of substantially straight rod members are fixed. The upper ends of the rear legs 77*a* are jointed to the lower surfaces of the rear portions of the armrests 74.

The front legs 73*b* are provided downward from the two corners of the front-end side of the lower surface of the seat portion 72*b* of the second chair 71, and the mid portions of the rear legs 77*b* are fixed to both ends of the rear end portion of the seat portion.

The upper ends of the pair of the rear legs 77*b* are connected to each other, and formed into the backrest 75*b* bent towards the rear side in an L-shape, and a backrest 76*b* is formed in such a manner that the upper and lower ends thereof are fixed to the mid portion of the backrest 75*b* and the rear end surface of the seat portion 72*b*. The mid portions of the front legs 73*b* and the rear legs 77*b* are connected via a reinforcing rod 78 having a square bracket shape (]) to each other for three sides excluding the rear side of the seat portion 72*b*.

The seat portion 72*b* of the second chair 71*b* is set at such a height that the upper surface thereof is brought into contact with the lower surface of the seat portion 72*a* of the first chair 71*a*. The lengths of the front legs 73*a* and the rear legs 77*a* of the first chair 71*a* are determined so that they are grounded on the floor when the first chair 71*a* is stacked upon the second chair 71*b*.

When the first chair 71*a* is stacked upon the second chair 71*b*, the measurements in terms of the front-rear direction are determined so that the backrest 75*b* of the second chair 71*b* is fitted to the lower surface side of the backrest 75*a* of the first chair 71*a*, and the back plate 76*b* of the second chair 71*b* is fitted to the back surface of the back plate 76*a* of the first chair 71*a*. The distance between legs and the positions thereof in terms of the front-rear direction are determined so that the pair of the front legs 73*b* of the second chair 71*b* are fitted between the inner sides, in terms of the width direction, of the pair of the front legs 73*a* of the first chair 71*a*, and the rear legs 77*b* are fitted to the back portions of the rear legs 77*b* of the first chair 71*a*.

According to the combination chair having the above-described structure, the first chair 71*a* and the second chair 71*b* are stacked up together, and can be used as one chair.

When the first and second chairs 71*a* and 71*b* are combined together, the backrest 75*b* of the second chair 71*b* is fitted to the lower surface side of the backrest 75*a* of the first chair 71*a*, thus exhibiting an appearance as if they are one backrest.

Further, when the two chairs are combined, the pair of the front legs 73 of the second chair 71*b* are fitted on the inner sides of the pair of the front legs 73*a* of the first chair 71*a*, thus suppressing the shaky movement of the chairs in the right-to-left direction, and the backrests 75*a* and 75*b* are fitted with each other in the up-and-down direction, thus suppressing the shaky movement in the up-and-down movement. Furthermore, the rear legs 77*a* and 77*b*, and the backrests 76*a* and 76*b* are fitted in terms of the front-rear direction, thus suppressing the shaky movement in the front-rear direction.

With the above structure, if the two chairs are used as one chair, they can be used comfortably without looseness.

ADVANTAGE OF THE INVENTION

As described above, the present invention has the structure in which a plurality of chairs each having a seat portion supported by legs and a backrest provided on the seat portion, can be stacked up together, without looseness or having a shaky movement.

With the plurality of chairs, the number of chairs can be increased or decreased in accordance with an increase or decrease in the number of users. A plurality of chairs are stacked up when the number of chairs is decreased, and therefore an extra space is not necessary.

Further, the plurality of chairs stacked up are prevented from being loose, and they do not shakily move. Therefore, the chairs, if they are combined, can be easily used.

We claim:

1. A combination chair comprising a plurality of chairs, wherein each of said plurality of chairs comprises:

a seat portion supported by legs; and a backrest provided on the seat portion, the backrests of each of said plurality of chairs being coupled to the seat portion such that when said plurality of chairs are combined so that the seat portions thereof are stacked upon each other in an up-and-down direction, the backrests of said plurality of chairs are adjacent to each other at one side in a width direction of the backrest; and wherein the legs of each of said plurality of chairs have lengths such that when said plurality of chairs are combined so that the seat portions thereof are stacked upon each other in an up-and-down direction, the legs contact a support surface on which the combination chair is placed.

2. The combination chair according to claim 1, wherein when the chairs are combined, the legs of said plurality of chairs are adjacent to each other in a lateral direction such that a longitudinal portion of each leg is adjacent to a longitudinal portion of another leg, and such that the adjacent legs extend in a width direction of the legs.

3. The combination chair according to claim 1, wherein:

the seat portion of each of said plurality of chairs is formed in a circular shape; and the backrests of each of said plurality of chairs, when the chairs are combined, are adjacent to each other along a circumferential direction of said seat portions when said seat portions are stacked upon each other.

* * * * *

UNITED STATES PATENT AND TRADEMARK OFFICE

CERTIFICATE OF CORRECTION

PATENT NO. : 5,632,524

DATED : May 27, 1997

INVENTOR(S) : IKEDA et al.

It is certified that error appears in the above-identified patent and that said Letters Patent is hereby corrected as shown below:

Title page, Item [22] PCT Filed:, change: "Jun. 12, 1995" to --September 6, 1994--

Signed and Sealed this

Twenty-fourth Day of February, 1998

*Attest:*

Bruce Lehman

BRUCE LEHMAN

*Attesting Officer*

*Commissioner of Patents and Trademarks*